US007373749B1

(12) United States Patent
Lewis

(10) Patent No.: US 7,373,749 B1
(45) Date of Patent: May 20, 2008

(54) VEHICLE IDENTIFICATION CARD WITH REMOVABLE KEY TAG

(75) Inventor: Mark W. Lewis, Greenville, SC (US)

(73) Assignee: Marjen, Inc., Greenville, SC (US)

( * ) Notice: Subject to any disclaimer, the term of this patent is extended or adjusted under 35 U.S.C. 154(b) by 178 days.

(21) Appl. No.: 11/448,495

(22) Filed: Jun. 7, 2006

(51) Int. Cl.
*G09F 3/10* (2006.01)

(52) U.S. Cl. ..... 40/673; 40/6; 40/634

(58) Field of Classification Search ..... 40/673–675, 40/633, 638, 665, 299.01; 283/70, 100, 103, 283/81, 80
See application file for complete search history.

(56) References Cited

U.S. PATENT DOCUMENTS 4,846,501 A 7/1989 Del Grande ..... 282/9 R
4,907,359 A 3/1990 Berman ..... 40/299
5,782,497 A 7/1998 Casagrande ..... 283/110
6,352,287 B2 3/2002 Casagrande ..... 283/81
6,352,608 B1 3/2002 Garden ..... 156/249

*Primary Examiner*—Cassandra Davis
(74) *Attorney, Agent, or Firm*—Charles L. Schwab; Nexsen Pruet, LLC

(57) ABSTRACT

A vehicle identification and locator card for vehicle parking and servicing establishments includes a sheet of paperboard card having an upper segment and a pair of side by side lower segments. A two ply laminate patch is applied to the back side of one of the lower segments. The two plies are bonded by a dry release adhesive. The outline of an arrow shaped ignition key tag is formed by die cutting through the paper card and through the laminate ply adhered directly to the one lower segment.

3 Claims, 3 Drawing Sheets

VEHICLE IDENTIFICATION CARD WITH REMOVABLE KEY TAG

RELATED APPLICATION

Related pending U.S. patent applications include Ser. No. 10/860,459 filed Jun. 3, 2004 for a Vehicle Locator and Identification Card; Ser. No. 11/007,509 filed Dec. 8, 2004 for a Vehicle Locator and Identification Card; Ser. No. 11/076,351 filed Mar. 9, 2005 for a Service Hang Tag and Ser. No. 11/342,791 filed Jan. 30, 2006 for a Vehicle Identification Card.

BACKGROUND OF THE INVENTION

Businesses concerned with parking or servicing vehicles have a problem of correlating the ignition key and the vehicle owner with a particular vehicle. Paper cards with three segments separated by perforations and carrying the same number have been provided so that one segment serves as a claim check, a second segment is placed in the vehicle and a third segment has a key ring stapled to it. A computer type multiple copy form with perforated tear-off strips has been proposed for correlation of ignition key, vehicle and customer which includes perforation lines permitting separation of the form into sections—one to be placed on the vehicle, one to be connected to the ignition key in some undisclosed manner and one to be given to the automobile owner as a claim check. It has been found that in inclement weather, the paper vehicle key tag can become wet; causing it to lose strength, thereby increasing the risk of it breaking and a consequential loss of the key.

BRIEF DESCRIPTION OF THE INVENTION

A three segment automotive vehicle locator card is formed from a thick sheet of pliable paperboard material. A matching identification number is printed on all segments of the card. The segments are established by perforations or slits which permits the segments to be easily separated from one another. A large upper segment of the card includes a punched out hole and a slit from the hole to an upper edge of the card which permits the upper segment to be attached to the rear view mirror bracket of the vehicle. A second segment is a customer's claim check or ticket. The third segment of the card includes a removable arrow shaped key tag. A two ply Mylar laminate in the form of an adhesive type reinforcing tape is placed on the back side of the third segment covering the entire arrow shaped key tag. The outline of the arrow is defined by a cut punched through the paperboard and the immediately adjacent ply of the reinforcing Mylar tape. The hole and slot in the tail are also punched through the synthetic paper and both plies of the Mylar laminate. Upon removal of the key tag with its adjacent ply of the Mylar tape, the head of the arrow is inserted into a T-shaped slot in the tail of the arrow to form a ring for holding an ignition key. The ply of the Mylar tape adhering to the back side of the key tag substantially strengthens the key tag and adds durability in event of moisture.

BRIEF DESCRIPTION OF THE DRAWINGS

The invention is illustrated in the accompanying drawings, in which.

DETAILED DESCRIPTION OF THE INVENTION

Figure 1:
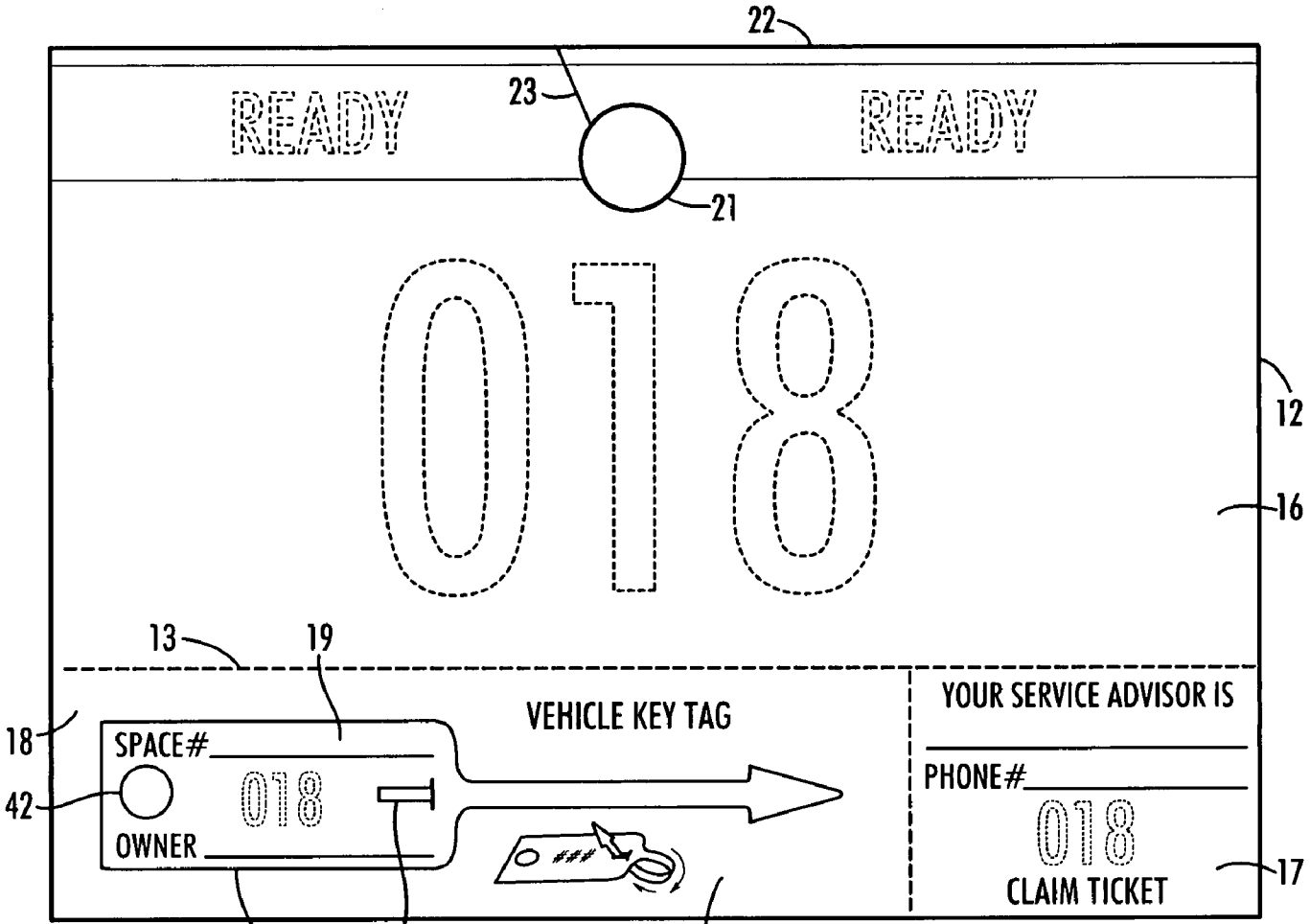
FIG. 1 shows the front side of a vehicle identification and locator card.

The vehicle locator card shown in the drawings includes a relatively thick pliable paperboard sheet 12 which is perforated along a horizontal line 13 and along a vertical line 14 to form an upper segment 16, a first lower segment 17 serving as a claim ticket and second lower segment 18, in which a key tag 19 is formed. The upper segment 16 includes a punched out hole 21 near its upper edge and a slot 23 between the hole 21 and the upper edge 22 of the segment 16 permitting the upper segment 16 to be hung in the vehicle—such as on a rear view mirror support. The perforations along lines 13 and 14 permit relatively easy separation of the segments 16, 17, 18 from one another.

Figure 2:
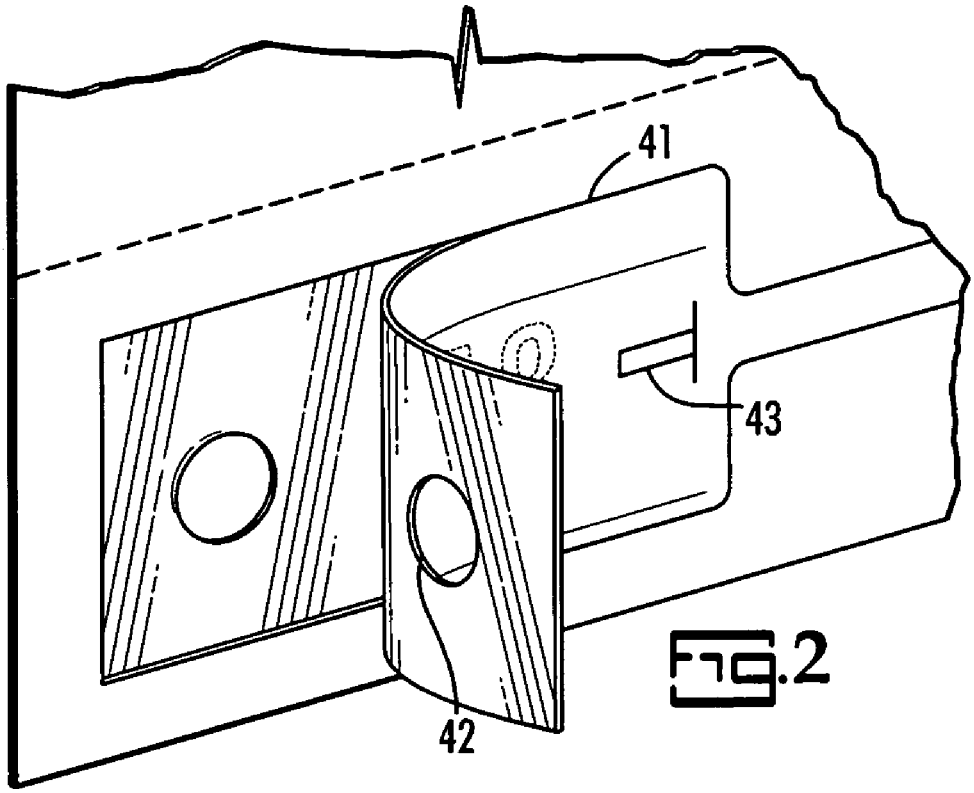
FIG. 2 shows the key tag partially removed from the front side of the card.
Figure 4:
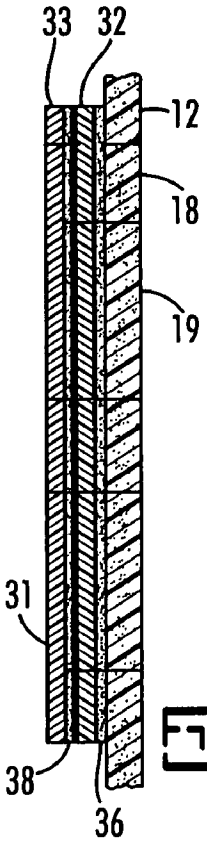
FIG. 4 is a section taken on the line 4-4 in FIG. 3.
Figure 3:
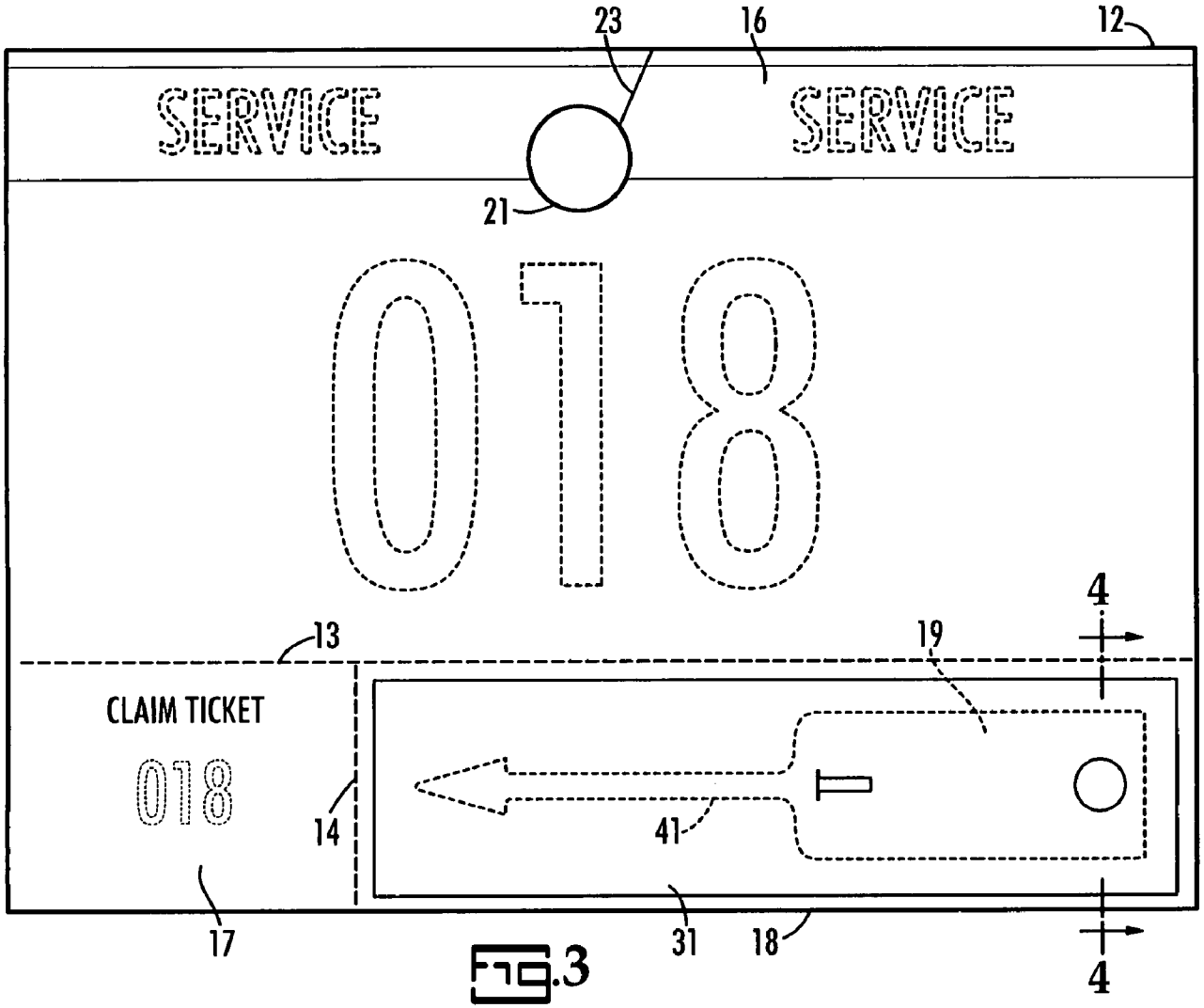
FIG. 3 shows the rear side of the card shown in FIG. 1.

As shown in FIGS. 2 and 4, the rear side of the second lower segment 18 has a two ply clear plastic laminate patch 31 secured to its rear side which includes a first ply 32 and a second ply 33. The patch 31 covers the key tag arrow 19 die punched through the card 12 and the first ply 32. The clear plastic first ply 32 is securely fastened to the rear of the second segment 18 by a relatively strong bonding adhesive 36. The opposite side of the first ply 32 is secured to the clear plastic second ply 33 by a clean release adhesive 38.

The arrow shaped outline 41 of the key tag 19, is die cut through the paperboard 12, through the first ply 32 and through the clean release adhesive 38. A hole 42 and a rectangular shaped slot 43 are die cut through the paperboard 12 and both plies 32, 33 of the laminate patch 31. The key tag 41 can easily be removed from the second lower segment 18 as shown in FIG. 2. The point and shank of the arrow shaped key tag 19 can then be placed through a key ring and the head inserted into the slot 43. The hole 42 in the tail of the arrow shaped key tag 19 is provided for hanging the key tag 19 on peg, not shown.

What is claimed is:

1. A vehicle identification card, comprising:

a sheet of paperboard having a front side and rear side, said sheet being divided by perforations into an upper segment servicing as a hang tag, and at least one lower segment containing a key tag, a laminate patch having two plies of clear plastic laminated by a clean release adhesive, one of said plies being adhesively secured to the rear side of said one lower segment, and a die cut through said one lower segment of said paperboard and through said one ply of said laminate patch forming a removable arrow shaped key tag having an arrow head, a shank and a tail and said die cut forming a hole in said tail for hanging said key tag and a slot in said tail through which said head is insertable.

2. The vehicle identification card of claim 1 wherein said arrow shaped key tag as removed from said one lower segment includes the portion of said one ply of clear plastic laminate adhesively secured to its rear side.

3. The vehicle identification card of claim 2 including a second lower segment in side-by-side relation to said one lower segment, said second lower segment being a claim ticket.

* * * * *